US006485677B1

(12) United States Patent
Johansson et al.

(10) Patent No.: US 6,485,677 B1
(45) **Date of Patent: *Nov. 26, 2002**

(54) METHOD FOR MAKING SINTERED PRODUCTS AND A METAL POWDER COMPOSITION THEREFOR

(75) Inventors: Björn Johansson, Höganäs (SE); Ulf Engström, Höganäs (SE)

(73) Assignee: Höganäs AB, Höganäs (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/464,072

(22) Filed: Dec. 16, 1999

Related U.S. Application Data

(63) Continuation of application No. PCT/SE98/01275, filed on Jun. 26, 1998.

(30) Foreign Application Priority Data

Jun. 26, 1997 (SE) ..... 9702466

(51) Int. Cl.[7] ..... B22F 3/12
(52) U.S. Cl. ..... 419/38; 419/36
(58) Field of Search ..... 419/38, 36

(56) References Cited

U.S. PATENT DOCUMENTS 3,972,108 A * 8/1976 Ericson et al. ..... 29/420.5
4,483,905 A * 11/1984 Engstrom ..... 428/570
4,699,763 A 10/1987 Sinharoy et al.
4,702,772 A * 10/1987 Engstrom et al. ..... 75/243
4,834,800 A 5/1989 Semel
5,154,881 A * 10/1992 Rutz et al. ..... 419/37
5,744,433 A * 4/1998 Strorstrom et al. ..... 508/454
5,926,686 A * 7/1999 Engstrom et al. ..... 419/37

FOREIGN PATENT DOCUMENTS

| | | |
|---|---|---|
| EP | 0353523 A2 | 2/1990 |
| JP | 9003504 A | 1/1990 |
| JP | 2161701 A | 6/1990 |
| JP | 8143901 A | 6/1996 |
| WO | WO94/02273 | 2/1994 |
| WO | WO94/11124 | 5/1994 |
| WO | WO95/33589 | 12/1995 |

* cited by examiner

*Primary Examiner*—Daniel J. Jenkins
(74) *Attorney, Agent, or Firm*—Burns, Doane, Swecker & Mathis, LLP

(57) ABSTRACT

This invention relates to a metal powder composition for warm compaction. According to the invention, the invention comprises metal powder, graphite, optional binding agent, optional alloying elements and a lubricant essentially consisting of ethylene-bis-stearamide, whereby the mixture before warm compaction has been subjected to treatment with an organic solvent. The invention further relates to a method for making sintered products, whereby an organic solvent is added during the mixing of the metal powder composition and is evaporated before warm compaction.

23 Claims, No Drawings

METHOD FOR MAKING SINTERED PRODUCTS AND A METAL POWDER COMPOSITION THEREFOR

This is a continuation of International Application No. PCT/SE98/01275, filed Jun. 26, 1998, that designates the United States of America and which claims priority from Swedish Application No. 9702466-5, filed Jun. 26, 1997.

This invention relates to a method for making sintered products. Particularly the invention concerns the preparation of sintered products by warm compacting a metal powder composition.

During the last years the use of warm compaction within powder metallurgy has gained increased interest as it has been found that compaction at temperatures above ambient temperature has evident advantages. It has thus been found that, at the same compaction pressure, powders compacted at an elevated temperature will result in products having higher density and higher strength than products produced by compacting the same powders at ambient temperature (cold compaction). Both in warm and in cold compaction a lubricant has to be used either for lubrication of the tool or as a part of the metal powder to be compacted. It has however been found that, when using conventional cold compaction lubricants for warm compaction, the wear on the compaction tool increases. Another problem is that a higher force for ejecting the compact from the compacting tool might be required. This higher ejection force may damage not only the tool but also the compact. In order to eliminate these problems special lubricants for warm compaction have been developed, see e.g. U.S. Pat. No. 5,154,881 and EP 762 946.

It has now unexpectedly been found that the use of an organic solvent could make the traditionally cold compaction lubricants useful in warm compaction.

In brief, the present invention concerns the warm compaction and sintering of a metal powder and the preparation of this metal powder comprises the steps of:

providing a dry mixture of metal powder, lubricant and optionally one or more additives selected from the group consisting of graphite, alloying elements, binding agents, processing aids and hard phases;

adding an organic solvent to the metal powder composition obtained, optionally in combination with a binding agent; and evaporating the solvent for obtaining a dry mixture.

The warm compaction and sintering of the dried metal powder is subsequently carried out at conventional temperatures and pressures.

A special important feature of the invention is to make it possible to use lubricants, such as H-wax™ and Acrawax™, which are based on essentially pure ethylene-bisstearamide for warm compaction. In this context it should be mentioned that the high-melting-point wax lubricants ADVAWAX®450 or PROMOLD®450 which have been developed especially for warm compaction and which are disclosed in U.S. Pat. No. 5,154,881, are not suitable lubricants according to the present invention. These lubricants are made up of a mixture of diamides, monoamides, bisamides and polyamides, the ethylene-bisstearamide product being less than approximately 50% by weight.

In the warm compaction process disclosed in the patent application WO 94/02273 these high-melting-point waxes, i.e. ADVAWAX®450 or PROMOLD®450, are used together with organic solvents, such as acetone, in a method including a two-step addition of lubricant in order to modify or finely tune the apparent density of the metallurgical powder composition without significantly adversely affecting other properties, such as flow, green strength or compressibility, of the powder. In contrast the method of preparing the metal powder for warm compaction according to the present invention requires that the lubricant is added before the addition of organic solvent. Preferably the lubricant addition is carried out in one step.

As used in the present description and the appended claims, the expression "metal-powder" encompasses powder essentially made up of pure iron, which may be prepared through water atomisation or from sponge iron; iron powder that has been partially prealloyed or prealloyed, (the prealloyed powder preferably being prepared by water atomisation) with other substances improving the strength, the hardening properties, the electromagnetic properties or other desirable properties of the end products; and particles of iron mixed with particles of such alloying elements (diffusion mixture or purely mechanical mixture). Examples of alloying elements are copper, molybdenum, chromium, manganese, phosphorus, carbon in the form of graphite, and tungsten, which are used either separately or in combination, e.g. in the form of compounds ($Fe_3P$ and FeMo). Unexpectedly good results are obtained when the lubricants according to the invention are used in combination with iron-based powders having high compressibility. Generally such powders have a low carbon content, preferably below 0.01% by weight. Such powders include e.g. Distaloy AE, Astaloy Mo, ASC 100.29 and SC 100.26 all of which are commercially available from Hoganas AB, SWEDEN.

The lubricant is preferably a fatty acid amide wax having an acid number less than 12. Most preferably the lubricant is essentially pure ethylene-bisstearamide having an acid number less than 8, such as H-wax and Acrawax mentioned above.

Apart from the metal powder and the lubricant according to the invention, the metal powder composition may contain one or more additives selected from the group consisting of binders, processing aids and hard phases. The binder may be added to the powder composition in accordance with the method described in U.S. Pat. No. 4,834,800 (which is hereby incorporated by reference).

The binder used in the metal-powder composition may consist of e.g. cellulose ester resins, hydroxyalkyl cellulose resins having 1–4 carbon atoms in the alkyl group, or thermoplastic phenolic resins.

The processing aids used in the metal powder composition may consist of talc, forsterite, manganese sulphide, sulphur, molybdenum disulphide, boron nitride, tellurium, selenium, barium difluoride and calcium difluoride, which are used either separately or in combination.

The hard phases used in the metal powder composition may consist of carbides of tungsten, vanadium, titanium, niobium, chromium, molybdenum, tantalum and zirconium, nitrides of aluminium, titanium, vanadium, molybdenum and chromium, $Al_2O_3$, $B_4C$, and various ceramic materials.

The organic solvent used according to the invention is preferable selected from the group consisting of alcohols and ketones. Specific examples of alcohols are methanol and ethanol and examples of ketones are acetone. The amount of organic solvent may vary between 0.5 and 10%, preferably between 1 and 6% by weight of the metal composition.

The temperature for the warm compaction may vary between 60° C. and 200° C., preferably between 80° C. and 150° C. and most preferably between 90° C. and 130° C. and the compaction pressure may vary between 200 and 1000 MPa, preferably between 400 and 900 MPa and most preferably between 400 and 800 MPa. The sintering is carried out at temperatures and times conventionally used in the PM industry, i.e. at temperatures above 1050° C. and for periods between 15 and 60 minutes.

The invention also concerns the metal powder mixture for warm compaction prepared according to the above method.

Below follows an example where a lubricant commonly used in the PM industry for cold compaction is used in warm compaction according to the invention. The lubricant selected is technical ethylene-bisstearamide, H-wax®, available from Hoechst AG, Germany.

EXAMPLE

The three following metal powder compositions were prepared:

A: A steel-based powder, partially pre-alloyed with
4% by weight of Ni
1.5% by weight of Cu
0.5% by weight of Mo
0.55% by weight of graphite
0.60% by weight of lubricant B: A steel-based powder, partially pre-alloyed with
4% by weight of Ni
1.5% by weight of Cu
0.5% by weight of Mo
0.55% by weight of graphite
0.50% by weight of lubricant
0.10% by weight of binding agent,
the binding agent being added as a 10% solution in acetone. After total mixing the acetone was evaporated.

C: A steel-based powder, partially pre-alloyed with
4% by weight of Ni
1.5% by weight of Cu
0.5% by weight of Mo
0.55% by weight of graphite
0.60% by weight of lubricant
During the dry mixing of the metal powder composition 3% by weight of acetone was added. After total mixing the acetone was evaporated.

The three compositions were then compacted. The table below indicates Powder Temperatures, Tool Temperatures, Compaction Pressures, Green Density (GD), Sintered Density (SD) and Radial Crushing Strength (RCS).

| Composition | Powder Temp. ° C. | Tool Temp. ° C. | Comp. Press. MPa | GD g/cm$^3$ | SD g/cm$^3$ | RCS N/mm$^2$ |
|---|---|---|---|---|---|---|
| A | 90 | 90 | 600 | 7,19 | 7,19 | 1336 |
| | | | 700 | 7,26 | 7,27 | 1392 |
| | | | 800 | 7,31 | 7,32 | 1415 |
| B | 110 | 120 | 600 | 7,24 | 7,25 | 1500 |
| | | | 700 | 7,32 | 7,33 | 1611 |
| | | | 800 | 7,35 | 7,36 | 1630 |
| C | 110 | 120 | 600 | 7,27 | 7,27 | 1494 |
| | | | 700 | 7,34 | 7,34 | 1572 |
| | | | 800 | 7,36 | 7,38 | 1588 |

The green density and the sintered density was measured according to ISO 2738-1973, and the radial crushing strength was measured according to ISO 2739-1973.

As appears from the table above, the green densities, sintered densities and redial crushing strengths were significantly higher with metal powder compositions and method according the invention with metal powder compositions and a method involving the use of an organic solvent according to the invention. The reason for using the lower temperature for the compaction of powder A is the insufficient flow performance of powder mixes containing the lubricant without the organic solvent pre-treatment at temperatures above 90° C.

The powder and tool temperatures for the different metal powder compositions were optimised to provide sufficient filling of the tool in each case.

What is claimed is:

1. A method for the preparation of a mixture for forming a sintered product, the method comprising the following steps:

providing a dry mixture of a metal powder, lubricant and optionally one or more additives, wherein the lubricant consists of essentially pure ethylene-bis-stearamide having an acid number less than 8;

adding and mixing an organic solvent to the metal powder composition obtained, optionally in combination with a binding agent;

evaporating the solvent; and forming a shaped article by warm compacting the mixture at a temperature between 60° C. and 200° C.

2. Method according to claim 1, characterised in that the lubricant is added in one step.

3. Method according to claim 1, characterised in that the metal powder is an iron-based powder and that the additive is selected from the group consisting of graphite, alloying elements, binding agents, processing aids and hard phases.

4. Method according to claim 3, characterised in that the iron-based powder is an essentially pure iron powder, a diffusion alloyed iron powder or a prealloyed iron powder.

5. Method according to claim 4, characterised in that the iron-based powder has a carbon content less than 0.01% by weight.

6. Method according to claim 1, characterised in that the organic solvent is selected from the group consisting of alcohols or ketones.

7. Method according to claim 1, characterised in that the alcohol is methanol or ethanol.

8. Method according to claim 1, characterised in that the ketone is acetone.

9. Method according to claim 1, characterised in that the amount of organic solvent varies between 0.5 and 10, % by weight of the dry mixture.

10. Method according to claim 2, characterised in that the organic solvent is selected from the group consisting of alcohols or ketones.

11. Method according to claim 3, characterised in that the organic solvent is selected from the group consisting of alcohols or ketones.

12. Method according to claim 4, characterised in that the organic solvent is selected from the group consisting of alcohols or ketones.

13. Method according to claim 2, characterised in that the alcohol is methanol or ethanol.

14. Method according to claim 3, characterised in that the alcohol is methanol or ethanol.

15. Method according to claim 2, characterised in that the ketone is acetone.

16. Method according to claim 3, characterised in that the ketone is acetone.

17. Method according to claim 1, characterised in that the amount of organic solvent varies between 1 and 6% by weight of the dry mixture.

18. Method according to claim 2, characterised in that the amount of organic solvent varies between 0.5 and 10% by weight of the dry mixture.

19. Method according to claim 3, characterised in that the amount of organic solvent varies between 0.5 and 10% by weight of the dry mixture.

20. Method according to claim 1, wherein the warm compacting is carried out with a compaction pressure of between 200 and 1000 MPa.

21. Method according to claim 1, further comprising sintering the shaped article at a temperature above 1050° C.

22. Method according to claim 1, wherein the ethylene-bis-stearamide having an acid number less than 8 is H-WAX or ACRAWAX.

23. Method according to claim 1, further comprising adding the binder to the dry mixture, the binder being selected from cellulose ester resins, hydroxyalkyl cellulose resins having 1–4 carbon atoms in the alkyl group and thermoplastic phenolic resins.

* * * * *